US008492668B2

(12) United States Patent
Broly

(10) Patent No.: US 8,492,668 B2
(45) Date of Patent: Jul. 23, 2013

(54) EMERGENCY SWITCH

(76) Inventor: Fabien Broly, Colmar (FR)

( * ) Notice: Subject to any disclaimer, the term of this patent is extended or adjusted under 35 U.S.C. 154(b) by 330 days.

(21) Appl. No.: 13/062,930

(22) PCT Filed: Sep. 9, 2009

(86) PCT No.: PCT/FR2009/051695
§ 371 (c)(1),
(2), (4) Date: Mar. 8, 2011

(87) PCT Pub. No.: WO2010/029254
PCT Pub. Date: Mar. 18, 2010

(65) Prior Publication Data

US 2011/0168534 A1 Jul. 14, 2011

(30) Foreign Application Priority Data

Sep. 10, 2008 (FR) ..... 08 56069

(51) Int. Cl.
*H01H 3/20* (2006.01)
*H01H 13/14* (2006.01)

(52) U.S. Cl.
USPC ..... 200/318.2; 200/520

(58) Field of Classification Search
USPC ..... 200/519, 520, 523–528, 537–542, 200/318–318.2, 320, 323–331, 334, 341
See application file for complete search history.

(56) References Cited

U.S. PATENT DOCUMENTS

| | | | | |
|---|---|---|---|---|
| 4,182,943 | A * | 1/1980 | Butterworth | 200/318.2 |
| 4,255,633 | A * | 3/1981 | Johnston et al. | 200/534 |
| 4,703,141 | A * | 10/1987 | Grunst | 200/318.2 |
| 5,626,223 | A * | 5/1997 | Lee | 200/529 |
| 6,518,529 | B2 * | 2/2003 | Bonn et al. | 200/520 |
| 7,371,986 | B2 * | 5/2008 | Varland et al. | 200/520 |
| 7,790,996 | B2 * | 9/2010 | Swamy et al. | 200/318.2 |
| 8,207,466 | B2 * | 6/2012 | Singh et al. | 200/538 |

FOREIGN PATENT DOCUMENTS

| | | | |
|---|---|---|---|
| DE | 35 33 891 | A1 | 7/1986 |
| DE | 196 07 562 | A1 | 9/1997 |
| EP | 0 667 631 | A | 8/1995 |
| EP | 1 734 434 | A | 12/2006 |
| WO | 00 60621 | A | 10/2000 |
| WO | 01 69618 | A | 9/2001 |

* cited by examiner

*Primary Examiner* — Michael Friedhofer
(74) *Attorney, Agent, or Firm* — Andrew W. Chu; Craft Chu PLLC

(57) ABSTRACT

The invention relates to an emergency switch that includes a body receiving a mobile member capable of translation and capable, under the effect of an axial pressure through a mushroom member, of moving from an extended position into a retracted position. Each of the positions are indexed by a blocking device capable of interaction with an extended position notch and with a retracted position notch, the position change being managed by a guide. The body fixedly includes, in the inside thereof, a concentric bushing in which the mobile member is capable of axially moving and which includes a portion of the guide while the mobile member includes the other portion. The blocking device is made in the shape of a piece of material flexibly and elastically attached to the rest of the bushing via a blade.

7 Claims, 4 Drawing Sheets

Fig. 7
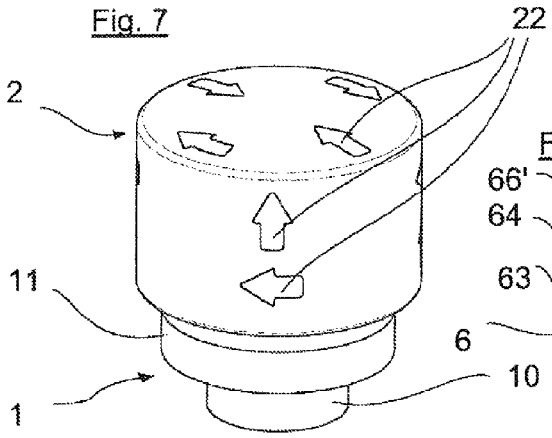
Fig. 8
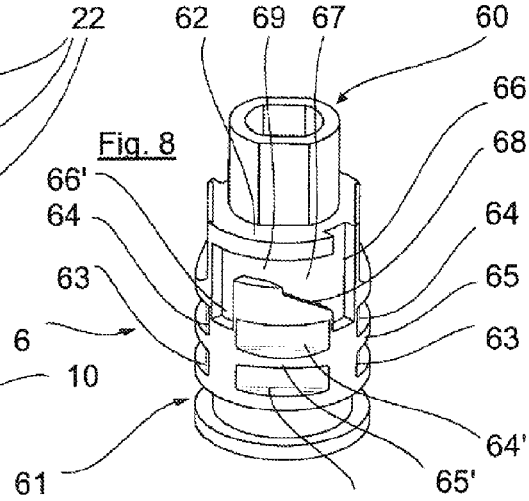
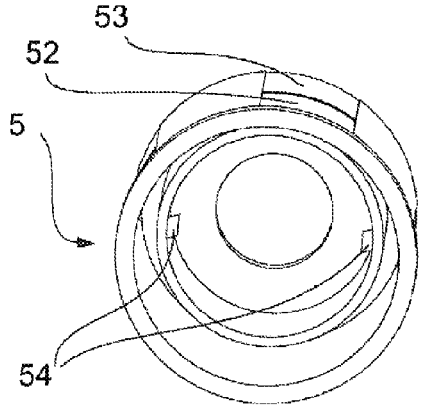
Fig. 9
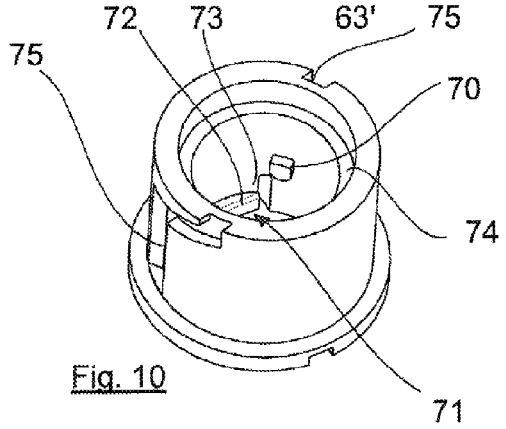
Fig. 10
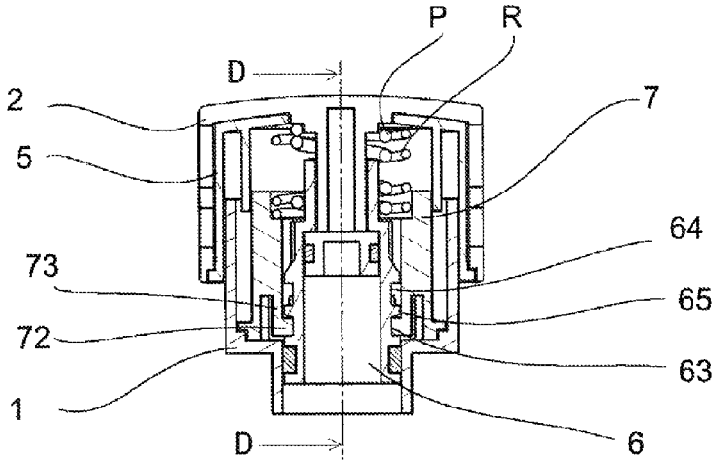
Fig. 11a

EMERGENCY SWITCH

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an emergency switch, comprising a body receiving means movable in translation capable, under the action of an axial thrust, of passing from an extended position into a retracted position, each of said positions being indexed through blocking means capable of cooperating with at least one indexing notch in an extended position and with at least one indexing notch in a retracted position.

An emergency switch is generally used for immediately stopping a device in operation or for quickly breaking a circuit or network. Such a switch will find its application in many technical fields, such as, and non-restrictively, on industrial chains and devices, machine-tools, and supply circuits, etc.

2. Description of Related Art Including Information Disclosed Under 37 CFR 1.97 and 37 CFR 1.98.

Such switches are already known, which are either of the "push-pull" type, in which the unblocking occurs through pulling, this is the case for the one described in U.S. Pat. No. 4,404,445, or of the "push-turn" type, in which the unblocking occurs through rotation, this is the case for the one described in EP 0 667 631. The drawback of these devices resides in that they are either of the "push-pull" type, or of the "push-turn" type, and in that, though the device of U.S. Pat. No. 4,404,445 can be of both types at the same time, it does not permit to be of one type or the other one.

In order to cope with this drawback, the present Applicant disclosed, in European application EP 1 734 434, an emergency switch that advantageously has the possibility of being unlockable through pulling and/or through rotation, while being likely to incorporate visual means permitting to signal their state, open or closed, consisting of either a light member or a mobile member cooperating with a window, and also likely to be provided with an arming system ensuring the non-return after triggering.

This switch comprises a member axially movable in the body, said member being provided with two longitudinally distributed notches, one for indexing in an extended position and the other one for indexing in a retracted position, aimed at cooperating with blocking means, while a guiding system, which comprises two parts cooperating with each other in sliding, permits to limit and to determine the evolutions in translation and in rotation of said mobile member with respect to said body.

The advantages this switch provides are essentially due to the fact that the blocking means has an annular shape comprising two parts, one for blocking around the mobile member, immobilized in rotation with respect to the body, and that it is shaped so as to be capable of alternately cooperating with either one of the indexing notches. This configuration permits in addition to liberate an important inner space likely to accommodate visual signaling means.

This switch has many advantages over the previous emergency switches, however it still has drawbacks, namely in that its design does not permit to manufacture the smallest emergency switches on the market.

Indeed, each emergency switch model is made in different sizes, adapted to the use made of same. Now, the above-mentioned emergency switch can technically not be manufactured, with all its remarkable features, in the smallest sizes, so that it does not permit to manufacture a complete range.

The object of the present invention is to provide a novel emergency switch permitting to cope with this drawback, the design of which permits, besides the possibility of a manufacture in all the sizes in use and besides the incorporation, on the one hand, of visual means for signaling its open or closed state and, on the other hand, of an arming system ensuring the non-return after triggering, to manufacture switches the unblocking of which can occur through pulling, through rotation, through pulling and through rotation, or through pulling or through rotation.

Furthermore, from the viewpoint of the manufacture, this switch requires one part less than the one object of EP 1 734 434, as well as less manual mounting operations.

SUMMARY OF THE INVENTION

The emergency switch according to the invention comprises a body receiving an member movable in translation capable, under the action of an axial thrust on a mushroom-like head integral with said mobile member, of passing from an extended position into a retracted position, each of said positions being indexed through at least one blocking means capable of cooperating with at least one indexing notch in an extended position and with at least one indexing notch in a retracted position, where said indexing notch in retracted position is shaped so as to permit said blocking means to be capable of being released from said notch through a rotary motion of said blocking means with respect to said indexing notch, as well as in an axial pulling motion of said mobile member with respect to said body, where said indexing notches are provided for on the periphery of said mobile member, and where the motion of unblocking, through pulling or through rotation, is conducted through guiding means comprising two parts cooperating with each other in sliding, the emergency switch being characterized in that said body includes, internally and firmly integral, a concentric bushing in which said mobile member can axially move, and which includes a portion of said guiding means, while the other portion is integral with said mobile member, one of said portions consisting of a spigot, while the other one consists of a groove in which said spigot is guided; and in that said blocking means is in the form of at least one piece of material flexibly and elastically attached, through a blade, to the rest of the bushing, internally to the latter, or to said mobile member externally to the latter, so as to provide said piece of material with a mobility in the radial direction, so that it can cooperate with an indexing notch said mobile member includes, externally to the latter, or said bushing, internally to the latter.

According to an additional feature of the emergency switch according to the invention, the bushing and the body are in the form of one single part resulting from molding, or in the form of two parts each resulting from molding, and firmly assembled during mounting.

According to another additional feature of the emergency switch according to the invention, the blocking means are arranged on the bushing, and the mobile member has two sets of indexing notches, each arranged in a different angular sector, and with either of which the blocking means can cooperate, and one of which is configured to permit an unblocking only through pulling and associated with guiding means permitting this pulling motion, the other one being configured to permit an unblocking only through rotation and associated with guiding means permitting this rotary motion, said guiding means consisting of at least one spigot capable of cooperating with at least two grooves configured differently in order for each of them to permit one of said motions, said two grooves being connected by a linking groove permitting, through a rotation of the mushroom-like head and, hence, of said mobile member in the bushing, to cause said spigot or spigots to pass from one groove into another one, so as to change the unblocking kinematics.

According to another additional feature of the emergency switch according to the invention, the guiding means comprise at least one groove provided for in the inner wall of the bushing, as well as at least one spigot that radially protrudes out of the mobile member and is inserted into said groove.

According to another variant of the emergency switch according to the invention, the guiding means comprise at least one groove provided for in the wall of the mobile member, as well as at least one spigot that radially protrudes out of the inner wall of the bushing and is inserted into said groove.

According to another additional feature of the emergency switch according to the invention, it includes, intercalated between the bushing and the mushroom-like head, a flywheel movable in axial rotation with respect to said mushroom-like head, the rotary motions of which are indexed and limited, through guiding means that connect said bushing and said flywheel, the latter having distinguishable areas, while said mushroom-like head includes openings in front of which said areas are positioned depending on the rotary motion of said flywheel, which motion depends in turn on the displacement of said mushroom-like head.

According to another additional feature of the emergency switch according to the invention, the guiding means permitting to index the movement of the flywheel with respect to that of the mushroom-like head, consist of at least one guiding groove the bushing includes on the outer side, and of at least one spigot said flywheel includes on the inner side, and which is designed capable of cooperating with said groove.

The advantages and features of the emergency switch according to the invention will become clear from the following description, which relates to the attached drawing that represents several non-restrictive embodiments of same.

BRIEF DESCRIPTION OF THE DRAWINGS

FIG. 3 represents a schematic perspective view of another part that this emergency switch is comprised of.

FIG. 4 represents a schematic perspective view of another part that this emergency switch is comprised of.

FIG. 7 represents a schematic perspective view of a second embodiment of an emergency switch according to the invention.

FIG. 8 represents a schematic perspective view of a part that this emergency switch includes.

FIG. 9 represents a schematic perspective view of another part that this emergency switch is comprised of.

FIG. 10 represents a schematic perspective view of another part that this emergency switch is comprised of.

FIG. 11*a* represents a schematic elevational and cross-sectional view according to a median plane of the same emergency switch, in a resting position.

DETAILED DESCRIPTION OF THE DRAWINGS

Figure 1:
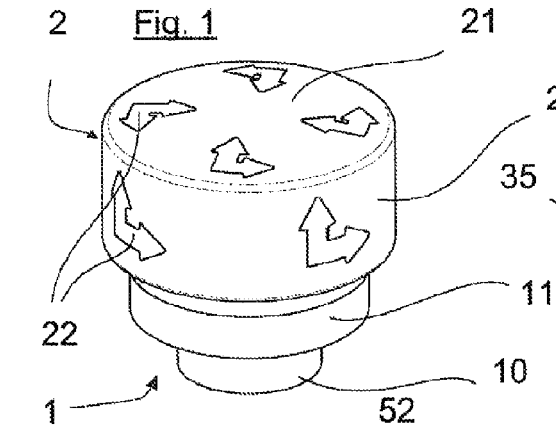
FIG. 1 represents a schematic perspective view of a first embodiment of an emergency switch according to the invention.

When referring to FIG. 1, one can see a first embodiment of an emergency switch according to the invention, which includes a base 1 for its fixing, and a mushroom-like head 2 aimed at receiving the thrust for actuating the switch.

The base 1 is in the form of a tubular part including two portions, a lower portion 10 with a diameter smaller than that of an upper portion 11, which creates an inner shoulder, not visible in the figure.

The mushroom-like head 2 is in the form of a cap comprising a tubular peripheral wall 20, closed at the top by a wall 21, these walls 20 and 21 being provided with openings 22 the characteristics and functions of which will be described below.

It should be noted that the switch according to the invention comprises essentially two operating positions, the resting position, or extend position, corresponding to the switch before triggering, and a working position, or retracted position, corresponding to the switch when it is actuated, after having pressed on the mushroom-like head 2, and which permits to interrupt a circuit.

Figure 2:
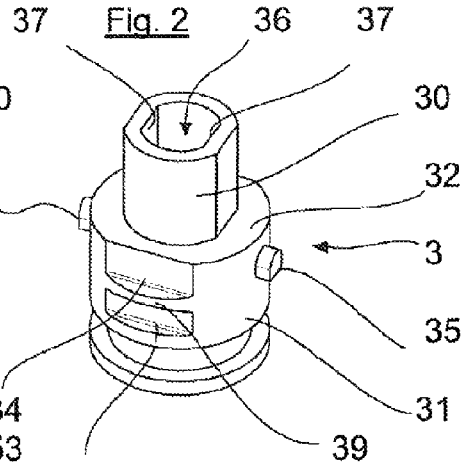
FIG. 2 represents a schematic perspective view of a part that this emergency switch includes.

When referring to FIG. 2, one can see a piston 3, which consists of an member movable in translation in the base under the action of an axial thrust on the mushroom-like head 2, which it is integral with, but not firmly fixed as will be described below.

This piston 3 is in the form of a tubular part comprising two portions, an upper portion 30 with a diameter smaller than that of a lower portion 31, thus creating between both of them a shoulder 32.

The lower portion 31, which has an outer diameter adjusted to the inner one of the lower portion 10 of the base 1, includes, axially superposed, two flat faces forming indexing notches, a notch referred to as "extending notch" 33, and a notch referred to as "retracting notch" 34, the latter being the one positioned on the side of the upper portion 30. It should be noted that the piston 3 includes, on its diametrically opposite side not visible in the figure, the same notches 33 and 34.

The lower portion 31 also includes, according to an angular shift of 90° with respect to the notches 33 and 34, two diametrically opposite spigots 35, which are protruding and are aimed at participating in the guiding of the translation of the piston 3.

Figure 3:
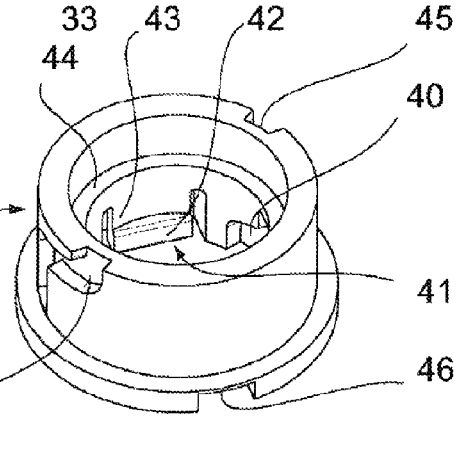

When referring now to FIG. 3, one can see a bushing 4 in the form of a tubular part, aimed at receiving the piston 3, and at permitting the latter to axially move inside it, and also aimed at being inserted into the base 2, and at being made integral with the latter, and in particular at the level of the inner shoulder of the latter, created by the difference in diameter between the lower 10 and upper 11 portions.

This bushing 4 includes on the inner side, on the one hand, two diametrically opposite grooves 40, only one of which is visible in the figure, in each of which a spigot 35 of the piston 3 can evolve and, on the other hand, angularly shifted by 90° with respect to the grooves 40, two diametrically opposite blocking members 41, only one of which is visible in the figure, and which each comprise an member 42 protruding towards the interior of the bushing 4, attached to the body of the latter through a blade 43, so as to provide this member 42 with a mobility in the radial direction, while restoring it into its original position, i.e. protruding towards the interior.

It should be noted that, according to a variant, the blocking means can be an integral part of the piston, and the notches can be arranged on the bushing.

The notch 4 also includes on the inner side, above the grooves 40 and the blocking means 41, a peripheral shoulder 44 and, on the outer side, two diametrically opposite grooves 45.

Figure 4:
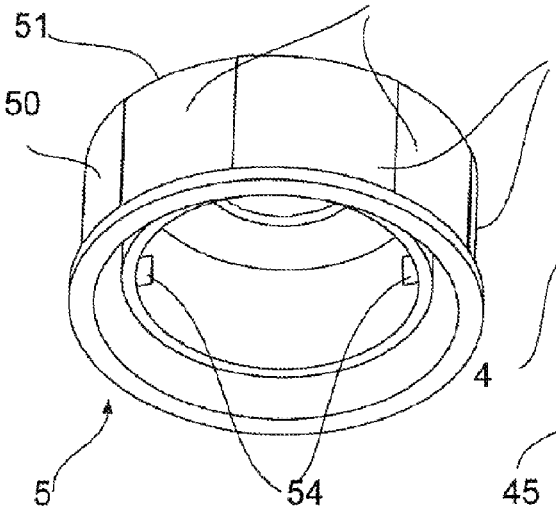

When referring now to FIG. 4, one can see a flywheel 5, in the form of a cap comprising a tubular peripheral wall 50 closed at the top by a wall 51, these walls comprising areas 52 and 53 of different colors. This flywheel 5 is aimed at being intercalated between the bushing 4 and the mushroom-like head 2, and it includes internally to the peripheral wall 50 spigots 54 designed capable of cooperating with the grooves 45 of the bushing 4.

Figure 5A:
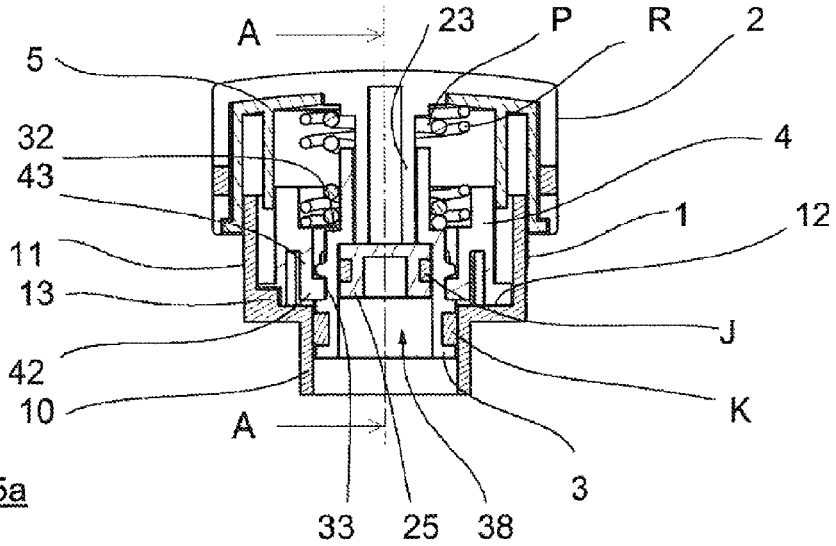
FIG. 5*a* represents a schematic elevational and cross-sectional view according to a median plane of the same emergency switch, in a resting position.
Figure 5B:
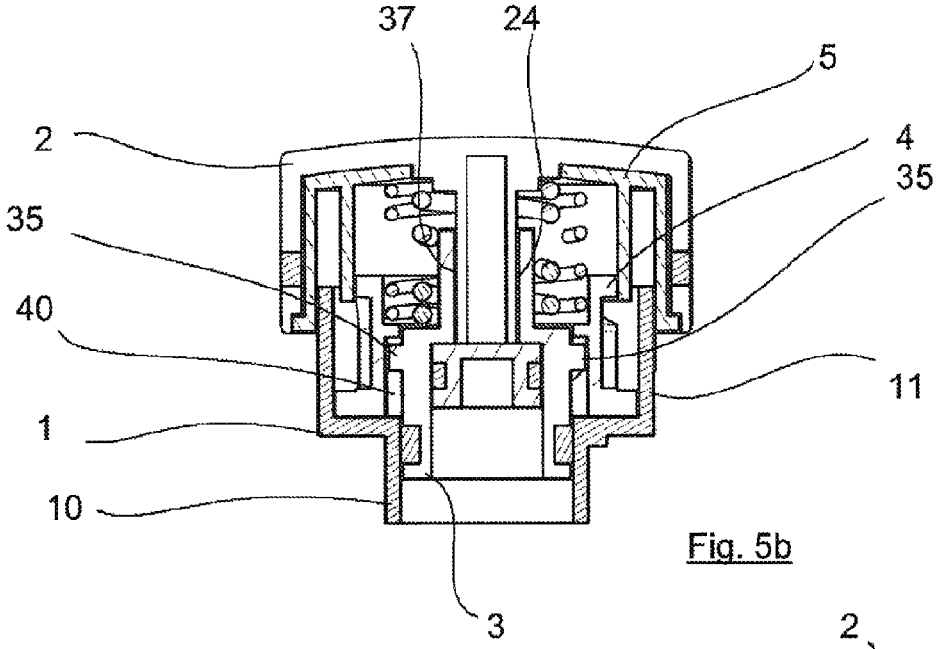
FIG. 5*b* represents a schematic cross-sectional view according to the axis A-A of FIG. 5*a*.

When referring now to FIGS. 5*a* and 5*b*, one can see an emergency switch according to the invention in the resting or extended position, formed of the assembling of all the above-described parts.

One can thus see the base 1 and its lower 10 and upper 11 portions, which delimit an inner shoulder 12 on which the bushing 4 rests. It should be noted that the bushing 4 is firmly made integral with the base 1, which can be made by gluing, or welding, or snapping-in, one should also note the presence of means for indexing the angular position of the bushing 4 with respect to the base 1, which consist, as can be seen in FIG. 5*a*, of a recess 46 provided for in the lower edge of the bushing 4, and of a stud 13 protruding out of the shoulder 12.

It should also be noted that the unit formed by assembling the base 1 and the bushing 4 can consist of one single part resulting from the molding.

In FIGS. 5*a* and 5*b*, one can also see the piston 3, which is inserted into the bushing 4, and which is made integral with the mushroom-like head 2, which occurs through a shaft 23 that extends axially in the mushroom-like head 2, which is inserted closely fitting in the axial cavity 36 the upper portion 30 of the piston 3 includes, this cavity 36 having a non-round transversal cross-section, in this case it includes flat surfaces 37, while the shaft 23 has externally a complementary profile, i.e. flat surfaces 24, so that the mushroom-like head 2 and the piston 3 are connected in rotation while permitting an axial translation with respect to each other. This translation is limited by fixing to the free end of the shaft 23 a plug 25 having a larger diameter and which can move in the cavity 38 the lower portion 31 of the piston 3 includes.

The flywheel 5 is inserted into the mushroom-like head 2, between the latter and the bushing 4 and, as can be seen in FIG. 5*b*, the spigots 35 are each inserted into a groove 40 of the bushing 4.

Finally, two coaxial helical springs are inserted into the shaft 23, a pre-stressing spring P intercalated between the mushroom-like head 2 and the shoulder 32 of the piston 3, and a restoring spring R intercalated between the mushroom-like head 2 and the peripheral spring 44 of the bushing 4.

The mounting is complemented with two annular tightness seals, namely a seal J fixed around the plug 25, and seal K fixed around the base of the piston 3.

In FIGS. 5*a* and 5*b*, the emergency switch according to the invention is in resting or extended position, which corresponds to the insertion of each of the members 42 of the blocking means 41 into a so-called "extending" notch 33.

Figure 6A:
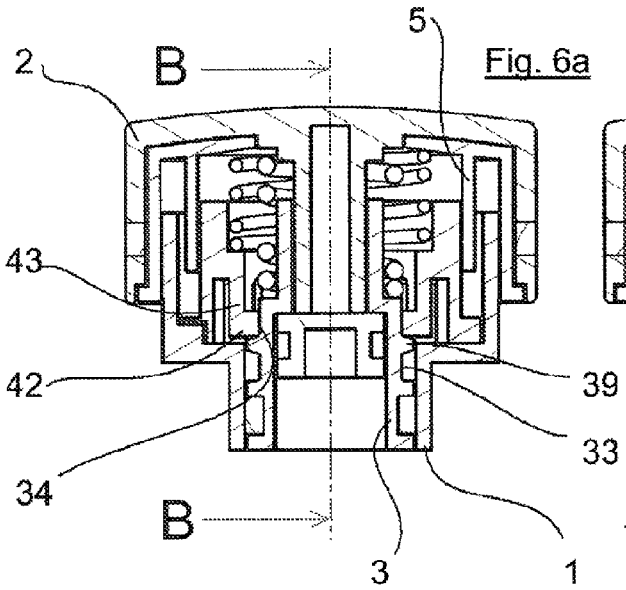
FIG. 6*a* represents a schematic elevational and cross-sectional view according to a median plane of the same emergency switch, in a working position.
Figure 6B:
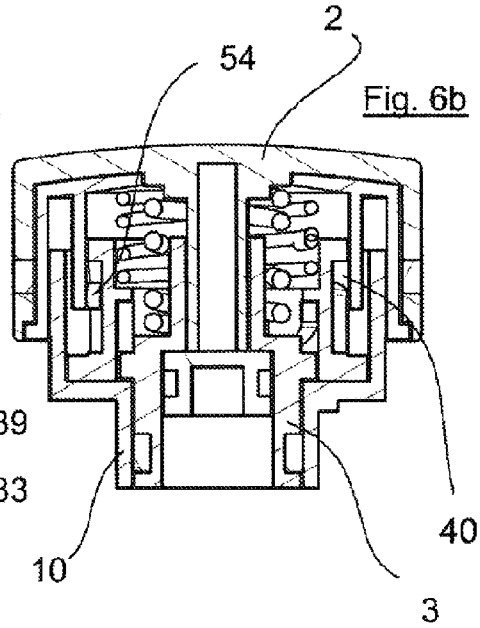
FIG. 6*b* represents a schematic cross-sectional view according to the axis B-B of FIG. 6*a*.

When referring now to FIGS. 6*a* and 6*b*, one can see the emergency switch according to the invention in working or retracted position, achieved by exerting an axial pressure onto the mushroom-like head 2, which pressure causes the compression of the pre-stressing spring P, the release of which causes the translation of the piston 3 in the base 1 in order to actuate a circuit breaker, not shown, the members 42 of the blocking means 41 each passing from a so-called "extending" notch 33 into a so-called "retracting notch" 34, by passing over the rib 39 separating both notches 33 and 34, tanks, on the one hand, to the flexibility of the blades 43 and, on the other hand, to the fact that the lower rim of the ribs 39 is chamfered.

The return into the resting or extended position can occur either by pulling the mushroom-like head 2 or by rotating it, the aim being to cause the members 42 of the notches 34 to pass into the notches 33.

The way of operating depends, on the one hand, on the form of the grooves 40 of the bushing, since they act as a guiding for the spigots 35 and, hence, for the piston 3 with respect to the bushing 4 and, on the other hand, on the profiles of the members 42 and the notches 33 and 34, in particular of the grooves 39.

Thus, it is possible, in a variant, to combine, on the one hand, longitudinal grooves 40, which permit only an axial displacement of the spigots 35 and, hence, of the piston 3 with respect to the bushing 4 and, on the other hand, ribs 39 that separate the notches 33 and 34, have a chamfered upper edge permitting the members 42 to escape from the notches 34 during an axial puling force.

It is also possible, in another variant, to combine, on the one hand, grooves 40 having a particular form, permitting the spigots 35 to evolve in same not only in the axial direction, but also in a transverse direction and, on the other hand, ribs 39 having an upper edge perpendicular to the main axis of the piston 3 in order to form a shoulder, so as to impede an axial return movement. Thus, the return into the resting position can occur only by causing the piston 3 to rotate with respect to the bushing 4, so that the members 42 escape from the notches 34 by their ends and not by passing over the ribs 39, the movement being complemented by the action of the spring R.

The embodiment of the emergency switch according to the invention represented in FIGS. 1, 2, 3, 4, 5*a*, 5*b*, 6*a*, 6*b*, 7*a* et 7*b* is a composition of both above-mentioned variants, in that it permits both possibilities, i.e. restoring into position through rotating or pulling, to this end the grooves 40, as can be seen in FIG. 3, permit these two movements, while the rib 39 has a chamfered upper edge.

It should be noted that, in parallel to the various above-mentioned functions, during the axial thrust exerted on the mushroom-like head 2, the flywheel 5 cooperates with the bushing 4, through the spigots 54 of the grooves 45, so as to cause the flywheel 5 to rotate and to thus bringing in front of the openings 22 the areas 52 or the areas 53, which permits to visually indicate the state of the switch.

When referring now to FIGS. 7, 8, 9, 10, 11*a*, 11*b*, 12*a*, 12*b*, 13*a* and 13*b*, one can see another embodiment of the switch according to the invention, which has the peculiarity of being able to be parameterized at will by the user, in order to be capable of being unlocked through pulling or through rotation.

This embodiment includes the same parts, i.e. a base 1, a mushroom-like head 2, a piston 6, a bushing 7 and a flywheel 5, which have the same characteristics, except for some exceptions.

Thus, as can be seen in FIG. 8, the piston 6 is also in the form of a tubular part comprising two portions, an upper portion 60 having a diameter smaller than that of a lower portion 61, thus creating a shoulder 62 between both of them.

The lower portion 61, which has an outer diameter adjusted to the inner one of the lower portion 10 of the base 1, includes on its periphery for angular sectors, the diametrically opposite sectors being identical.

Thus, two opposite sectors each include, axially superposed, two flat surfaces that create indexing notches, an "extending" one 63, and a "retracting" one 64, separated by a rib 65 the lower edge of which is chamfered, while the upper edge forms a shoulder.

The other two opposite sectors each include, axially superposed, two flat surfaces that form indexing notches, an "extending" one 63', and a "retracting" one 64', separated by a rib 65' the lower edge of which is chamfered, while the upper edge is chamfered.

Furthermore, the lower portion 61 includes between two neighboring sectors a longitudinal groove 66, and between the other two sectors a longitudinal groove 66', the groove 66 being laterally extended towards the groove 66', while passing above the notch 64', by a recess 67 delimited at the bottom above the notch 64' by an inclined plane 68 and which reaches the groove 66' through a transverse groove 69.

In FIG. 10, one can see that the bushing 7 is in the form of a tubular part, which includes on its inner side, on the one hand, two diametrically opposite spigots 70, only one of which is visible in the figure, aimed at cooperating with the grooves 66, 66', 68 and 69 of the piston 6 and, on the other hand, angularly shifted by 90° with respect to the spigots 70, two diametrically opposite blocking members 71, only one of which is visible in the figure, which each comprise an member 72 protruding towards the interior of the bushing 7, attached to the body of the latter through a blade 73, so as to provide this member 72 with a mobility in the radial direction, while restoring it into its original position, i.e. protruding towards the interior.

The bushing 7 also includes on the inner side, above the spigots 70 and the blocking means 71, a peripheral shoulder 74 and, on the outer side, two diametrically opposite grooves 75.

Figure 11B:
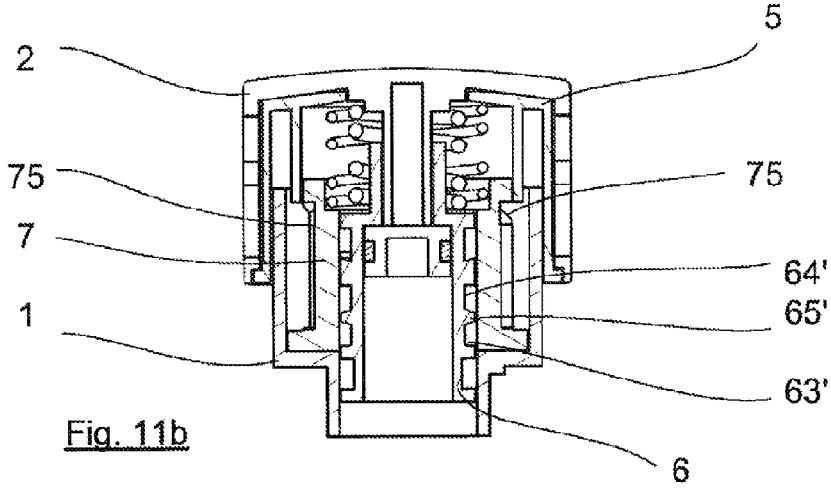
FIG. 11*b* represents a schematic cross-sectional view according to the axis D-D of FIG. 11*a*.

The characteristics of the piston 6 and the bushing 7 permit to contemplate two configurations depending on the angular positioning of the piston 6 with respect to the bushing 7, where in resting position, in the first one, shown in FIGS. 11*a* and 11*b*, the members 72 of the blocking means 71 are positioned in the notches 63, while the spigots 70 can evolve in the grooves 66 and 67, and in the second configuration, not shown, where they are positioned in the notches 63', while the spigots 70 can evolve in the grooves 66'.

Figure 12A:
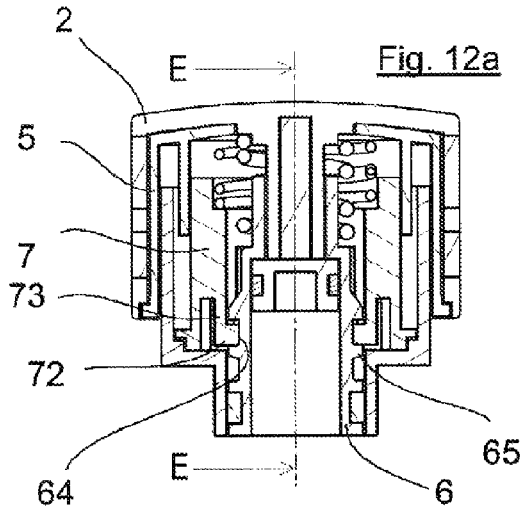
FIG. 12*a* represents a schematic elevational and cross-sectional view according to a median plane of the same emergency switch, in a working position.
Figure 12B:
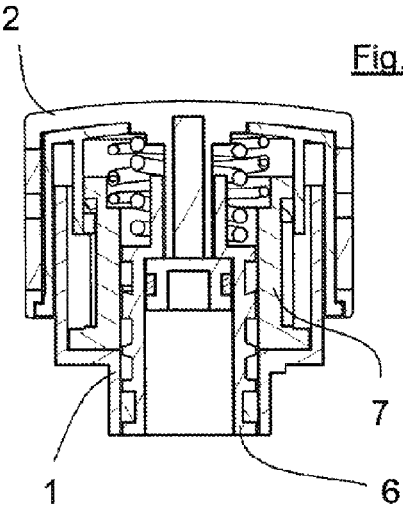
FIG. 12*b* represents a schematic cross-sectional view according to the axis E-E of FIG. 12*a*.
Figure 13A:
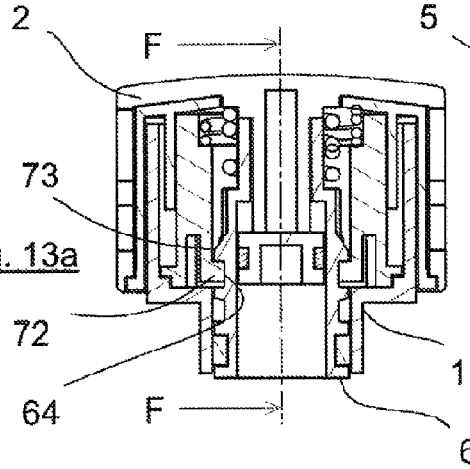
FIG. 13*a* represents a schematic elevational and cross-sectional view according to a median plane of the same emergency switch, in a forced position.
Figure 13B:
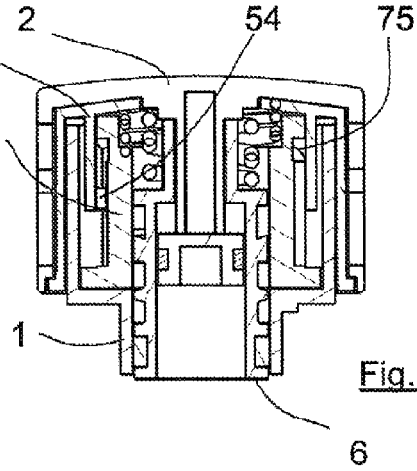
FIG. 13*b* represents a schematic cross-sectional view according to the axis F-F of FIG. 13*a*.

During the passing into working position, in the first case, shown in FIGS. 12*a* and 12*b*, the members 72 pass over the ribs 65 and pass into the notches 64, while, in the second case, the members 72 pass into the notches 64'.

One will understand that, in the case shown, since the ribs 65 have a shoulder at the top, the restoring into the initial position cannot occur by pulling on the mushroom-like head, but requires the latter to rotate for the members 72 to escape from the notches 64 by their side ends.

In parallel, the spigots 70 evolve in the grooves 66 and 67, which permits the rotary motion of the mushroom-like head 2 and, hence, of the piston 6 with respect to the bushing 7.

In the second case, not shown, the chamfered upper edge of the ribs 65' permits the return into the initial position by pulling, only movement permitted by the cooperation between the spigots 70 and the grooves 66'.

Thus, this embodiment of the emergency switch according to the invention can be configured either for a return into resting position by a pulling action or, for a return into resting position by a rotation action assisted by the spring R.

In a particularly advantageous way, it can be configured at will by the user. Indeed, when referring to FIGS. 13*a* and 13*b*, one can see that by exerting an additional pressure on the mushroom-like head 2, i.e. by bringing it into a so-called forced position and by exerting a rotation by a quarter of a turn, the members 72 are caused to pass from the notches 64 into the notches 64', or vice-versa, and likewise the spigots 70 of the bushing 7 from the grooves 66 and 67 into the grooves 66', or vice-versa, by causing them to pass through the linking grooves 69.

In parallel to these manipulations, the flywheel 5 is moved with respect to the mushroom-like head 2, which permits to cause the data relating to the configuration of the switch to be displayed on the latter.

Irrespective of the embodiment, the emergency switch according to the invention offers many advantages over those existing so far, and namely in that, besides all the functionalities it has, it can be manufactured in all sizes necessary on the market, and it requires a smaller number of parts and a reduced mounting time.

I claim:

1. Emergency switch, comprising a body receiving a mobile member, the member being movable in translation, under the action of an axial thrust on a mushroom-like head integral with said mobile member, the member passing from an extended position into a retracted position, each position being indexed through at least one blocking means cooperating with at least one indexing notch in an extended position and with at least one indexing notch in a retracted position, where said indexing notch in retracted position is shaped so as to permit said blocking means to be released from said notch through a rotary motion of said blocking means with respect to said indexing notch, as well as in an axial pulling motion of said mobile member with respect to said body, where said indexing notches are provided for on a periphery of said mobile member, and where the motion of unblocking, through pulling or through rotation, is conducted through guiding means comprising two parts cooperating with each other in sliding; and internally and firmly integral, a concentric bushing in which said mobile member can axially move, the bushing including a portion of said guiding means, while the other portion of the guide means is integral with said mobile member, one of said portions consisting of a spigot, while the other one consists of a groove in which said spigot is guided; said wherein said blocking means is in the form of at least one piece of material flexibly and elastically attached, through a blade, to the rest of the bushing, internally to the latter, or to said mobile member externally to the latter, so as to provide said piece of material with a mobility in the radial direction, so that it can cooperate with an indexing notch said mobile member comprises, externally to the latter, or said bushing, internally to the latter.

2. Emergency switch according to claim 1, wherein the bushing and the body are formed of one single part resulting from molding, or two parts resulting from molding and firmly assembled during the mounting.

3. Emergency switch according to claim 1, wherein the blocking means are arranged on the bushing, and wherein the mobile member has two sets of indexing notches, each notch being arranged in a different angular sector, the blocking means being cooperative with either set, at least one set being configured to permit an unblocking only through pulling and associated with guiding means permitting this a pulling motion, the other one set being configured to permit an unblocking only through rotation and associated with guiding means permitting this rotary motion, said guiding means being comprised of at least one spigot cooperating with at least two grooves configured differently in order for each of them to permit one of said motions, said two grooves being connected by a linking groove permitting, through a rotation of the mushroom-like head and, hence, of said mobile member in the bushing, to cause said spigot to pass from one groove into another one, so as to change the unblocking kinematics.

4. Emergency switch according to claim 1, wherein the guiding means comprise at least one groove provided for in the inner wall of the bushing, as well as at least one spigot that radially protrudes out of the mobile member and is inserted into said groove.

5. Emergency switch according to claim 1, wherein the guiding means comprise at least one groove provided for in the wall of the mobile member, as well as at least one spigot that radially protrudes out of the inner wall of the bushing and is inserted into said groove.

6. Emergency switch according to claim 1, further comprising:

a flywheel being intercalated between the bushing and the mushroom-like head and movable in axial rotation with respect to said mushroom-like head, the rotary motions of which are indexed and limited, through guiding means that connect said bushing and said flywheel, said flywheel having distinguishable areas, while said mushroom-like head further comprises openings in front of which said areas are positioned depending on the rotary motion of said flywheel, which motion depends in turn on the displacement of said mushroom-like head.

7. Emergency switch according to claim 6, wherein the guiding means permitting to index the movement of the flywheel with respect to that of the mushroom-like head comprises at least one guiding groove, the bushing having, on the outer side, and of at least one spigot said flywheel being on the inner side cooperating said flywheel with said groove.

* * * * *